US005799520A

United States Patent [19]

Laabs et al.

[11] Patent Number: 5,799,520

[45] Date of Patent: Sep. 1, 1998

[54] COMBINED LOCK AND LINEAR ACTUATOR

[75] Inventors: Timothy P. Laabs, Palatine; Brian M. Ott, Streamwood; John J. Crocco, Gurnee, all of Ill.

[73] Assignee: The Eastern Company, Naugatuck, Conn.

[21] Appl. No.: 612,086

[22] Filed: Mar. 7, 1996

[51] Int. Cl.[6] ..... E05B 29/04

[52] U.S. Cl. ..... 70/360; 70/421; 70/DIG. 30; 200/318.2

[58] Field of Search ..... 70/360, DIG. 30, 70/421, 367, 368, 369, DIG. 27; 200/43.07, 43.13, 318.2, 43.08

[56] References Cited

U.S. PATENT DOCUMENTS

| | | | |
|---|---|---|---|
| 1,288,074 | 12/1918 | Lutz | 70/DIG. 30 |
| 1,748,255 | 2/1930 | Tibbetts | 70/DIG. 30 X |
| 2,683,978 | 7/1954 | Jacobi | 70/360 |
| 2,883,848 | 4/1959 | Wolniak | 70/367 |
| 3,299,678 | 1/1967 | Spencer | 70/208 |
| 3,438,227 | 4/1969 | Wolniak | 70/208 |
| 3,639,708 | 2/1972 | Wolniak et al. | 200/44 |
| 3,956,912 | 5/1976 | Broska | 70/492 X |
| 4,009,599 | 3/1977 | Patriquin | 70/360 X |
| 4,380,915 | 4/1983 | Kincaid et al. | 70/224 |
| 4,405,843 | 9/1983 | Wolniak et al. | 200/44 |
| 4,565,080 | 1/1986 | Kincaid et al. | 70/215 |
| 4,566,167 | 1/1986 | Wolniak et al. | 29/437 |
| 4,630,457 | 12/1986 | Kincaid et al. | 70/369 |
| 4,633,689 | 1/1987 | Wolniak et al. | 70/379 R |
| 4,689,977 | 9/1987 | Wolniak et al. | 70/379 R |
| 4,854,140 | 8/1989 | Goodman | 70/360 X |
| 4,956,983 | 9/1990 | Okamura et al. | 70/DIG. 30 X |
| 5,111,007 | 5/1992 | Miller et al. | 200/43.08 |
| 5,212,972 | 5/1993 | Kincaid et al. | 70/208 |
| 5,235,832 | 8/1993 | Lux et al. | 70/368 |
| 5,265,454 | 11/1993 | Crocco et al. | 70/380 |

FOREIGN PATENT DOCUMENTS

| | | | |
|---|---|---|---|
| 103935 | 5/1938 | Australia | 70/360 |
| 815645 | 7/1937 | France | 70/201 |
| 1030017 | 6/1953 | France | 70/360 |
| 1915618 | 10/1970 | Germany | 70/360 |
| WO93/13967 | 7/1993 | WIPO | 70/360 |

*Primary Examiner*—Lloyd A. Gall

*Attorney, Agent, or Firm*—Wood, Phillips, VanSanten, Clark & Mortimer

[57] ABSTRACT

A combined lock/actuator for providing linear actuation including a lock barrel having an opening extending along a longitudinal axis, a spline in the opening extending along the longitudinal axis, a plug mounted in the opening, and a key-retractable tumbler carried by the plug and extending into the spline. The plug is rotatable within the opening over a fixed annular displacement between an actuation position and a release position. Further, the plug is translatable within the opening over a fixed axial displacement along the longitudinal axis between a first position and a second position. The tumbler extends into the spline when the plug is in the actuation position in the first position, when the plug is in the actuation position in the second position, and when the plug is in the actuation position in translating between the first and second positions.

20 Claims, 4 Drawing Sheets

COMBINED LOCK AND LINEAR ACTUATOR

TECHNICAL FIELD

The present invention is directed towards combined locks and actuators, and more particularly toward a combined lock/actuator for linearly actuating a driven member, such as a switch, to a desired position when the combined lock/actuator is locked and then maintaining the driven member in the desired position until the combined lock/actuator is unlocked.

BACKGROUND OF THE INVENTION

Linearly actuatable locks in the form of pop-handle locks are known in the art and generally involve a handle carrying a key lock having a rotatable plug disposed in a cylindrical lock barrel. The handle is translatable in a housing having a notch for receiving a bolt operated by the key lock. When the key lock releases the bolt from the notch, the handle is freed for linear actuation. U.S. Pat. Nos. 3,299,678 to Spencer, 3,438,227 to Wolniak, and 5,212,972 to Kincaid et al. all disclose pop-handle locks of this general type.

While such pop-handle locks are capable of providing linear actuation, they require housings in addition to the cylindrical lock barrel. More specifically, such pop-handle locks require a handle- housing to carry the cylindrical lock barrel and a separate housing to slidably receive the handle-housing. In addition to adding cost to the mechanism, these additional housings also complicate the packaging of the mechanism for any given product application.

U.S. Pat. Nos. 4,380,915 and 4,565,080 to Kincaid et al. disclose another type of linearly actuatable lock in the form of a key lock that is translatable in a housing having a notch for receiving a bolt operated by the key lock. More specifically, the key lock has a rotatable plug disposed in a cylindrical lock barrel which, in turn, is translatable in the housing. When the key lock releases the bolt from the notch, the cylindrical lock barrel is freed for linear actuation. Similar to pop-handle locks, these locks are capable of providing linear actuation, but require a housing in addition to the cylindrical lock barrel. More specifically, a separate housing is required to slidably receive the cylindrical lock barrel. Again, similar to pop-handle locks, the additional housing adds cost to the mechanism and complicates the packaging of the mechanism for any given product application.

Rotary switch locks are also known in the art. Generally, such switch locks involve a rotary-actuated switch mounted to the end of a cylindrical lock barrel, and a rotatable key plug mounted within the lock barrel to rotatably actuate the switch. U.S. Pat. No. 5,111,007 to Miller et al. and U.S. Pat. Nos. 3,639,708, 4,405,843, 4,427,852, 4,566,167, 4,633,689, and 4,689,977 to Wolniak et al. illustrate various types of such switch locks. While such switch locks provide acceptable rotary actuation of an electrical switch, they do not provide linear actuation.

The present invention is directed, in part, toward overcoming one or more of the problems discussed above.

SUMMARY OF THE INVENTION

In one aspect of the present invention, a combined lock/actuator for providing linear actuation includes a lock barrel having an opening extending along a longitudinal axis, a spline in the opening extending along the longitudinal axis, a plug mounted in the opening, and a key-retractable tumbler carried by the plug and extending into the spline. The plug is rotatable within the opening over a fixed annular displacement between an actuation position and a release position. Further, the plug is translatable within the opening over a fixed axial displacement along the longitudinal axis between a first position and a second position. The tumbler extends into the spline when the plug is in the actuation position and the first position, when the plug is in the actuation position and the second position, and when the plug is in the actuation position and translated between the first and second positions.

In another aspect of the invention, the combined lock/actuator further includes a stop in the opening of the barrel and first and second axially-extending surfaces on the plug. The first and second axially-extending surfaces have a length at least as great as the fixed axial displacement between the first and second positions. The first surface engages the stop when the plug is in either the first or second position and rotated to the actuation position. The second surface engages the stop when the plug is in either the first or second position and is rotated to a stop position.

In yet another aspect of the present invention, a combined lock/actuator is provided for actuating a driven member from a primary position to a secondary position when the actuator is locked and then maintaining the driven member in the secondary position until the actuator is unlocked. The combined lock/actuator includes a lock barrel, a lock plug, and an axial catch. The lock barrel has a longitudinal axis, an opening extending along the axis, and a recess. The plug is rotatable within the opening between an actuation position and a release position and translatable within the opening along the axis between a first position where a driven member is in a primary position and a second position where a driven member is in a secondary position. The axial catch is mounted on the plug and is engaged with the recess in the lock barrel when the plug is in both the actuation position and the second position.

In one aspect of the invention, the catch is mounted on the plug for transverse movement between an extended position with the catch engaging the recess, and a retracted position with the catch disengaged from the recess. An edge is provided on the barrel adjacent the recess. The edge engages the catch and forces the catch into the retracted position when the plug is rotated from the actuation position to the release position.

In another aspect of the invention, a switch is mounted to the barrel and has an activated position and a deactivated position. An end surface on the plug cooperates with a push button on the switch to place the switch in the activated position when the plug is in the second position and in the deactivated position when the plug is in the first position.

It is an object of the invention to provide a combined lock/actuator that can be linearly actuated to a desired position when the combined lock/actuator is locked and then maintained in that position until the combined lock/actuator is unlocked.

It is another object of the present invention to provide a combined lock/actuator providing the above enumerated features without requiring a complex assembly, and preferably, to provide such a lock/actuator combination that utilizes components similar to components commonly used in the art.

Numerous other features and advantages of the present invention will become readily apparent from the following detailed description of the invention, the accompanying figures, and the appended claims.

DETAILED DESCRIPTION OF THE PREFERRED EMBODIMENT

Although this invention is susceptible to embodiment in many different forms, the preferred embodiment of the invention is shown. It should be understood, however, that the present disclosure is to be considered as an exemplification of the principles of this invention and is not intended to limit the invention to the embodiments illustrated.

Figure 1A:
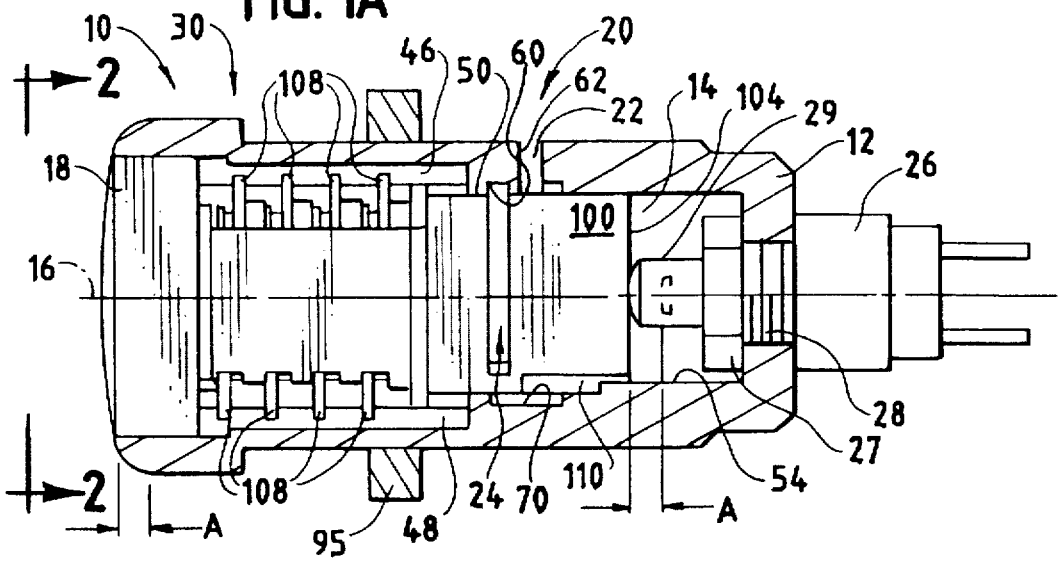
FIGS. 1A and 1B are diagrammatic side views and partial cross sections of a combined lock/actuator embodying the present invention, with an actuatable lock plug shown in a first position in FIG. 1A and in a second position in FIG. 1B.
Figure 1B:
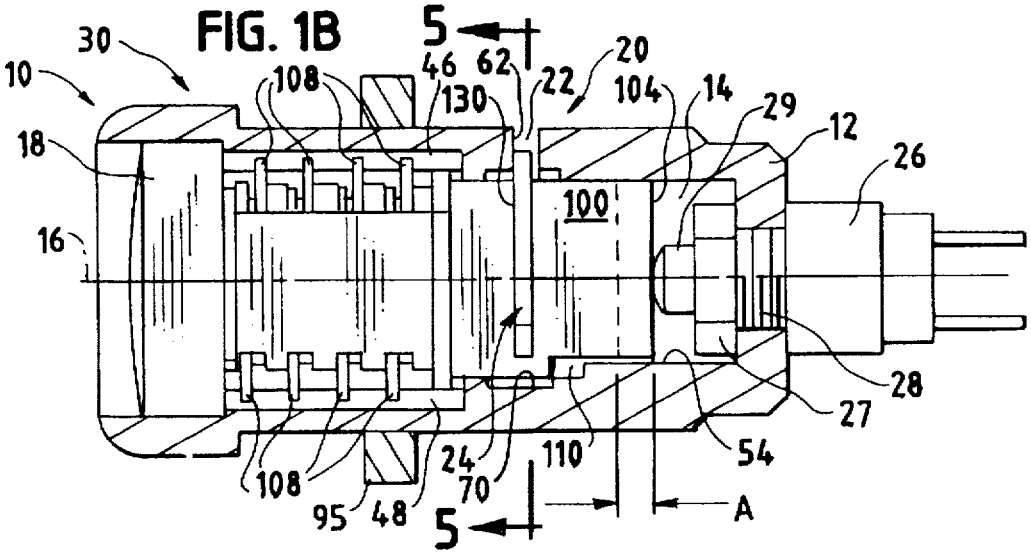
Figure 2:
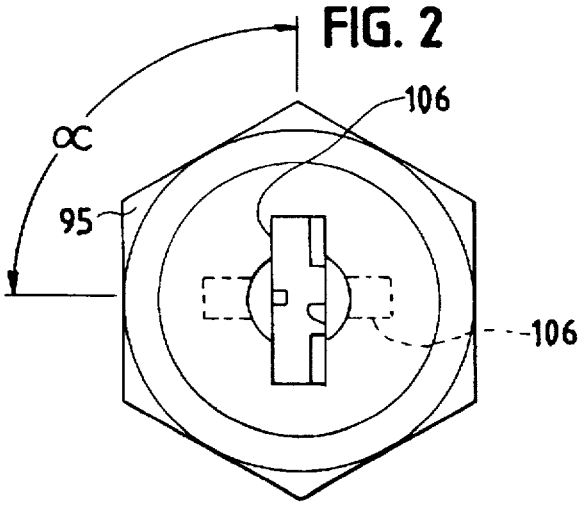
FIG. 2 is a left side view of the combined lock/actuator shown in FIGS. 1A from line 2—2 and shows the combined lock/actuator in an actuation position (solid lines) and a release position (dashed lines)

FIG. 1A illustrates a preferred embodiment of the present combined lock/actuator 10 that is suitable for linearly actuating a driven member to a desired position when the combined lock/actuator 10 is locked and then maintaining the driven member in the desired position until the combined lock/actuator 10 is unlocked. The combined lock/actuator 10 includes a lock barrel 12 having an opening 14 extending along a longitudinal axis 16, a rotatable lock plug 18 mounted for translation within the opening 14 over a fixed axial displacement A along the longitudinal axis 16 between a first position as shown in FIG. 1A and a second position as shown in FIG. 1B, and means 20 for preventing translation of the plug 18 from the second position. The means 20 is illustrated in the form of a transverse slot or recess 22 in the barrel 12 and a catch 24 extending from the plug 18 into the recess 22 when the plug 18 is in the second position, as shown in FIG. 1B. As shown in FIG. 2, the plug 18 is rotatable within the opening 14 over a fixed annular displacement $\alpha$ between an actuation position (shown in solid line) and a release position (shown with dash lines).

It will be appreciated that the invention anticipates axial displacements A and annular displacements $\alpha$ of greater and lesser magnitudes than those illustrated. For example, the annular displacement $\alpha$ is approximately 90° in the illustrated embodiment, but could be less than 90° or greater than 90° depending on the requirements for any given product application. Further, given tolerances and spacings and the like, the catch 24 may be sufficiently released from the recess 22 to allow the lock plug 18 to be returned to the first position after substantially less annular displacement than 90°. As such, the lock plug is in its release position at any point of annular displacement sufficient to release the catch 24 from the recess 22.

A driven member 26, shown in the form of a two-position push button switch 26, is mounted to the end of the barrel 12 by a nut 27 threaded onto a shaft 28 of the switch 26. Of course, other structures for mounting a switch to the end of the lock barrel could also be used. The switch 26 has a first operational mode and a second operational mode. The switch 26 includes a push button 29 that places the switch in the first operational mode when the push button 29 is in a primary position, as shown in FIG. 1A, and a second operational mode when the push button 29 is in a secondary position, as shown in FIG. 1B and the phantom lines X in FIG. 1A. The push button 29 is biased to the primary position by a spring (not shown) in the switch 26. In the preferred embodiment shown, the switch 26 is activated or closed in the first operational mode and deactivated or open in the second operational mode; however, it will be appreciated that this designation may be reversed if dictated by the particular product application. In combination, the switch 26 and the combined lock/actuator 10 form a push button switch lock 30.

Figure 3A:
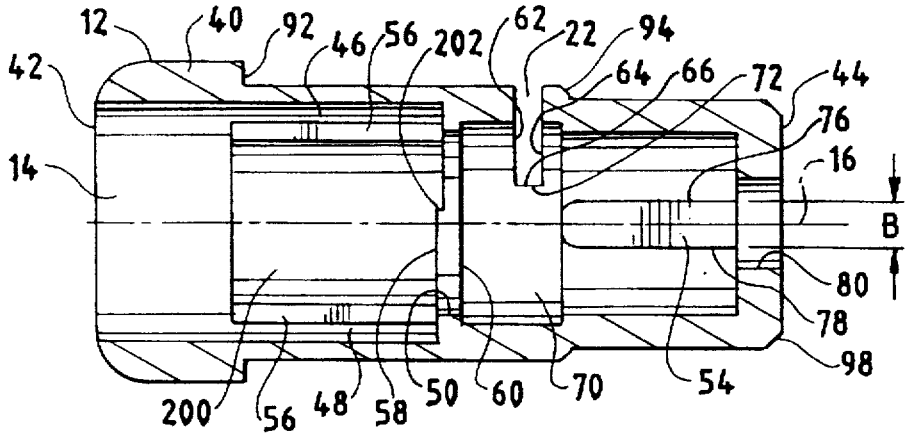
FIG. 3A is a cross-sectional view of the lock barrel of the combined lock/actuator shown in FIGS. 1A and 1B.
Figure 3B:
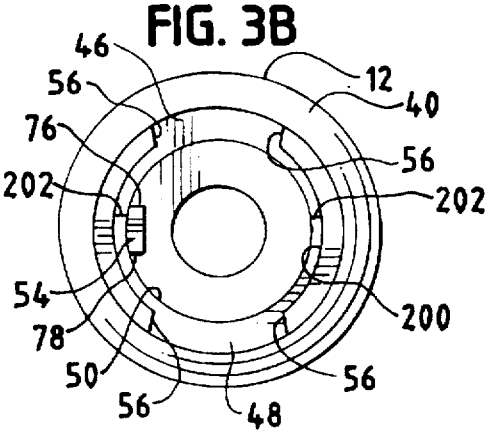
FIG. 3B is a left end view of the lock barrel shown in FIG. 3A.
Figure 5A:
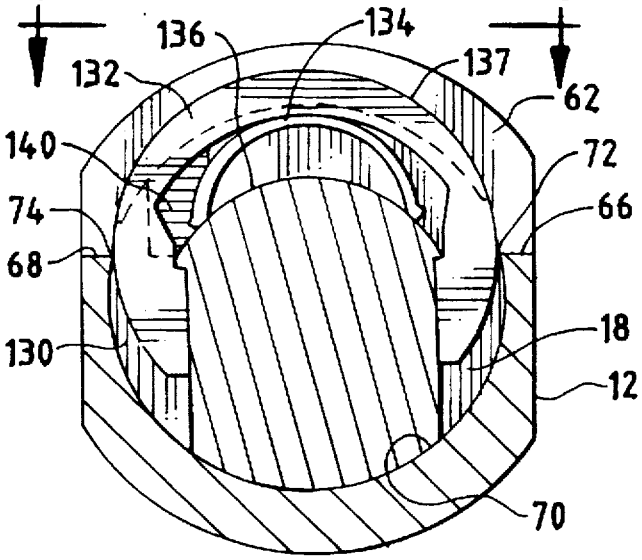
FIGS. 5A and 5B are section views taken along line 5—5 in FIG. 1B, with FIG. 5A showing the combined lock/actuator in an actuation position and FIG. 5B showing the combined lock/actuator in a release position.
Figure 5B:
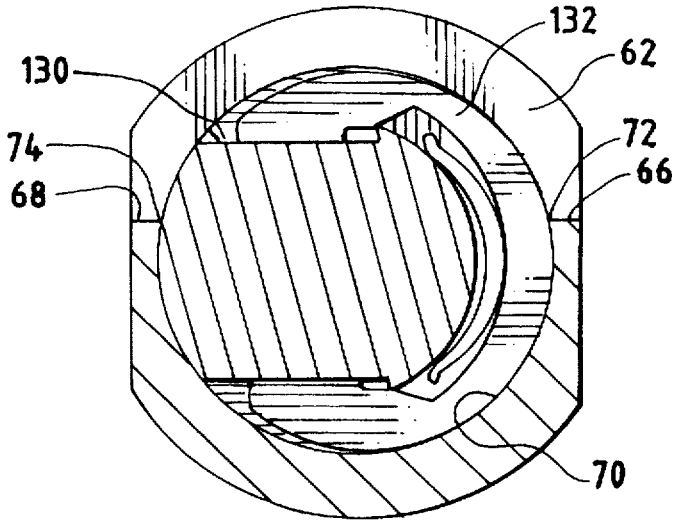

As best seen in FIG. 3A, the lock barrel 12 has a solid, generally cylindrical body 40, a first end 42, a second end 44. As best seen in FIGS. 3A and 3B, the lock barrel 12 further includes a pair of oppositely-spaced, recessed splines 46 and 48 extending along the longitudinal axis 16, an annular rib 50 adjacent the recessed splines 46 and 48, the slot or recess 22 formed by a transverse cut through the body 40, and a protruding stop 54 extending along the longitudinal axis 16 in the opening 14. Each of the splines 46 and 48 includes a pair of side walls 56 extending along the longitudinal axis 16 for the length of each spine 46 and 48. The annular rib 50 includes transverse end walls 58 and 60. The recess 22 is defined by two opposed transverse faces 62 and 64 and two oppositely-spaced lateral surfaces 66 and 68, as best seen in FIGS. 5A and 5B. The recess 22 interrupts a cylindrical surface 70 of the opening 14 and, as best seen in FIGS. 3A, 5A and 5B, thereby forming oppositely-spaced edges 72 and 74 at the intersection between the cylindrical surface 70 and the lateral surfaces 66 and 68. As best seen in FIGS. 3A and 3B, the stop 54 includes two oppositely-spaced side walls 76 and 78 extending along the longitudinal axis 16. The side walls are spaced by a distance B. Finally, cylindrical bore 80 extends along the horizontal axis 16 through the end 44 of the lock barrel 12.

Figure 3C:
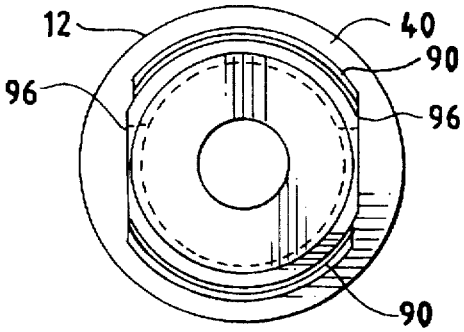
FIG. 3C is a right end view of the lock barrel shown in FIG. 3A.

As best seen in FIGS. 3A and 3C, external threads 90 are formed on the exterior of the body 40 and extend along the longitudinal axis 16 from a shoulder 92 to a chamfer 94. An internally threaded hex nut 95 is engageable with the threads 90. As best seen in FIG. 3C, two oppositely-spaced flats 96 are formed on the body 40 and extend along the longitudinal axis 16 from the shoulder 92 to a chamfer 98 adjacent the end 44. These features are well known in the art and are utilized for mounting the combined lock/actuator.

Figure 4A:
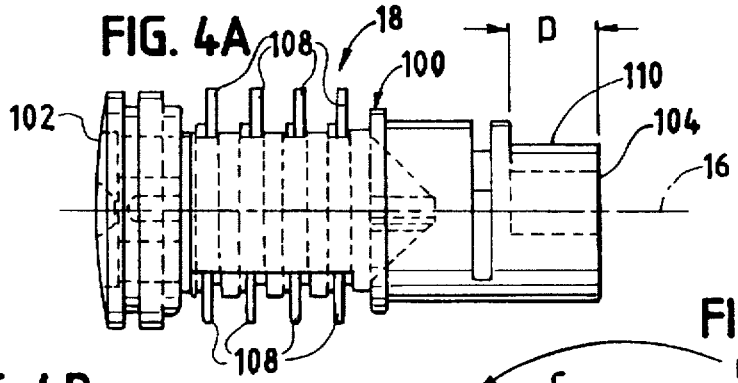
FIG. 4A is side view of the lock plug of the combined lock/actuator shown in FIGS. 1A and 1B.
Figure 4B:
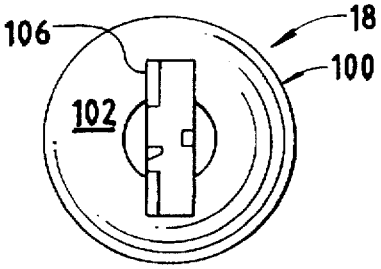
FIG. 4B is a left end view of the lock plug shown in FIG. 4A.
Figure 4C:
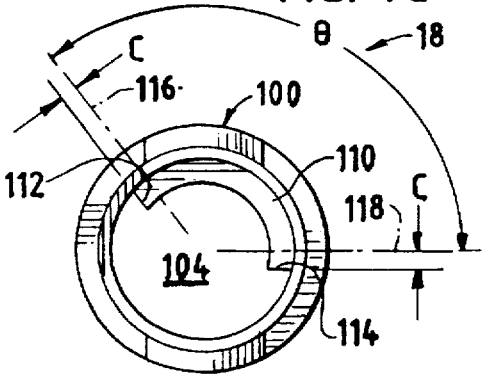
FIG. 4C is a right end view of the lock plug shown in FIG. 4A.

As best seen in FIGS. 4A, 4B, and 4C, the lock plug 18 has a generally cylindrical body 100 with a first end 102 and a second end 104. As best seen in FIGS. 2 and 4B, the lock plug 18 includes a key slot 106. An appropriately bitted key (not shown) may be inserted into the key slot 106 to retract key-retractable tumblers 108, as seen in FIGS. 1A and 1B, to provide clearance from the splines 46 and 48 in the barrel 12 to allow for rotation of the plug 18. Further details of the key slot 106, the key-retractable tumblers 108 and the internal structure of the lock plug 18 are not shown in detail in the Figures, as such structure is well known in the art, and any key slot, tumbler, and plug internal structure providing suitable key operation of the tumblers 108 would be usable with the present invention, as will become apparent from the description set forth below. An example of one suitable key slot, key-retractable tumbler, and internal plug structure combination is disclosed in detail in U.S. Pat. No. 5,235,832, issued Aug. 17, 1993 to Lux et al., the entire disclosure of which is herein incorporated by reference.

As best seen in FIGS. 4A and 4C, an arcuate relief 110 is formed on the body 100 and extends circumferentially between a first stop surface 112 and a second stop surface 114. The stop surface 112 is parallel to radially-extending line 116 and offset from the radially-extending line 116 by a distance C. Stop surface 114 is parallel to a radially-extending line 118 and offset from the radially-extending line 118 by the distance C. In the preferred embodiment, the distance C is approximately ½ the distance B (see FIG. 3A) between the side walls 78 and 76 of the stop 54.

The radial lines 116 and 118 are displaced from each other over the angle θ. The angle θ must be equal to or greater than the angle α between the actuation position and the release position. As best seen in FIG. 4A, the groove 110 and the stop surfaces 112 and 114 have a length D extending along the longitudinal axis 16. The length D is at least as great as the fixed axial distance A and, in the preferred embodiment, is greater than the fixed axial distance A, as seen in FIGS. 1A and 1B.

Figure 6:
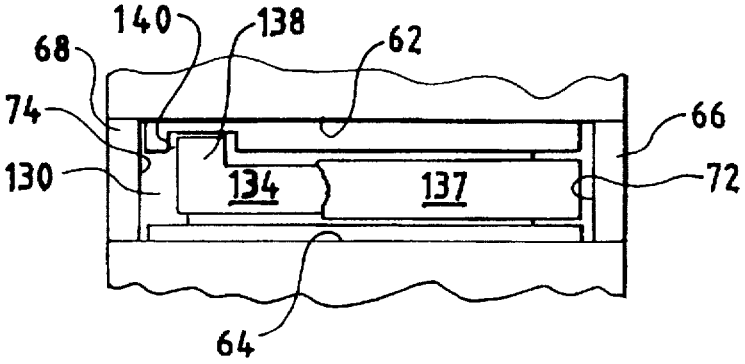
FIG. 6 is an enlarged, partial view taken from line 6—6 in FIG. 5A.
Figure 7:
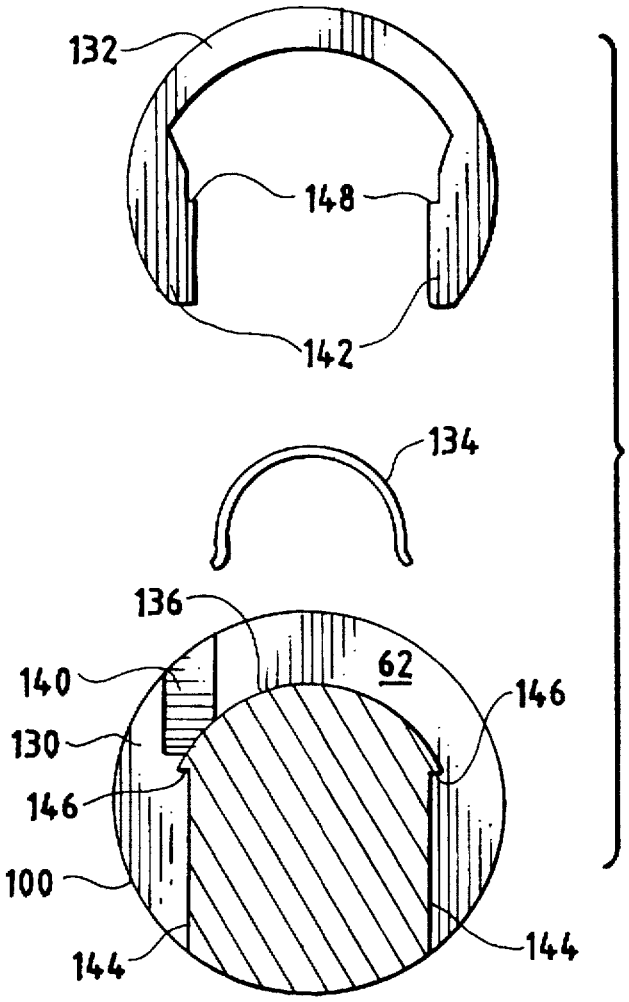
FIG. 7 is an exploded view of selected components from FIGS. 5A and 5B.

As best seen in FIGS. 1A and 1B, the catch 24 is mounted in an arcuate groove 130 formed in the body 100 of the lock plug 18. As best seen in FIG. 5A, the catch 24 is in the form of a generally C-shaped clip 132 that is biased to an extended position by a generally C-shaped leaf spring 134 that is interposed between the clip 132 and a circumferentially-extending surface 136 of the groove 130. The clip 132 includes a circumferential surface 137. As best seen in FIG. 6, an ear 138 is formed on one end of the leaf spring 134 and is received in a recessed channel 140 on one side of the groove 130. As best seen in FIG. 7, end portions 142 of the clip 132 slidably engage generally parallel guide surfaces 144 formed in the plug body 100 at the bottom of the groove 130 and permit transverse movement of the clip 132 into and out of the groove 130. Shoulders 146 extend generally at right angles from the guide surfaces 144 and are engaged by shoulders 148 on the inner surfaces of the end portions 142 of the clip 132, thereby limiting the outward movement of the clip 132 in the extended position, as shown in FIG. 1. Additional details of such a groove, clip, leaf spring and channel usable in the present invention are also disclosed in detail in U.S. Pat. No. 2,883,848, issued to Wolniak Apr. 28, 1959, the entire disclosure of which is incorporated herein by reference.

The operation of the combined lock/actuator 10 can best be understood by initially referencing FIGS. 1A and 1B, wherein the lock plug 18 is in the actuation position with the tumblers 108 extending into the splines 46 and 48 to prevent rotation of the lock plug 18 from the actuation position. In FIG. 1A, the push button 29 is biased to its primary position by the switch spring (not shown) and abuts the second end 104 of the lock plug 18 thereby biasing the lock plug 18 to the first position. The catch 24 (clip 132) is held in the retracted position by the cylindrical surface 70 of the lock barrel 12 and abuts surface 60 of the rib 50 to retain the lock plug 18 in the lock barrel 12.

To actuate the push button 29 from its primary position shown in FIG. 1A to its secondary position shown in FIG. 1B and thereby activate the switch 26, the lock plug 18 is pushed from its first position shown in FIG. 1A, to its second position shown in FIG. 1B. As the lock plug 18 moves from the first position to the second position, the tumblers 108 remain extended into the splines 46 and 48 to prevent rotation of the lock plug 18 from the actuation position. When the lock plug 18 reaches the second position, as shown in FIG. 1B, the catch 24 (clip 132 in FIG. 5A) is forced by the leaf spring 134 to its extended position into the recess 22. In this position, the face 62 of the recess 22 abuts the catch 24 (clip 132) to prevent translation of the lock plug 18 from the second position. The tumblers 108 remain extended into the splines 46 and 48. Thus, it will be appreciated that, when the plug is in both the actuation position and the second position, as shown in FIG. 1B, the catch 24 (clip 132) in the recess 22 maintains the push button 29 in its secondary position and the lock plug 18 in the second position.

To rotate the lock plug 18 from the actuation position (solid lines in FIG. 2) to the release position (dashed lines in FIG. 2) an appropriately bitted key (not shown) must be inserted into the key slot 106, thereby retracting the tumblers 108 from the splines 46 and 48. This allows the lock plug 18 to be freely rotated from the actuation position to the release position as shown in FIG. 2.

As best seen in FIGS. 5A and 5B, as the lock plug 18 is rotated from the actuation position (shown in FIG. 5A) to the release position (shown in FIG. 5B), the circumferential surface 137 of the clip 132 is engaged by the edge 72 and the cylindrical surface 70 which then force the clip 132 into its retracted position (shown in FIG. 5B). This disengages the clip 132 from the recess 22, thereby allowing the spring (not shown) in the switch 26 to force the lock plug 18 from the second position (shown in FIG. 1B) to the first position (shown in FIG. 1A) and the push button 29 from the secondary position (shown in FIG. 1B) to the primary position (shown in FIG. 1A) deactivating the switch.

It should be noted that the first stop surface 11 2 will abut the side wall 76 of the stop 54 if the lock plug 18 is rotated past the release position to a stop position that is displaced from the release position over an angle equal to θ minus α.

After the lock plug 18 has been rotated to the release position and then translated to the first position, the key may be removed from the key slot 106 by rotating the lock plug 18 from the release position to the actuation position. This allows the tumblers 108 to extend back into the splines 46 and 48 and resets the combined lock/actuator 10 for another cycle.

It should be noted that the second stop surface 114 abuts or engages the side wall 78 of the stop 54 to positively locate the lock plug 18 in the actuation position.

As best seen in FIGS. 3A and 3B, the lock barrel 12 further includes circumferential surfaces 200 extending between the splines 46 and 48. The lock barrel 12 also includes oppositely spaced shoulders 202 that are formed on the annular rib 50. During assembly of the lock plug 18 into the lock barrel 12, the circumferential surfaces 200 engage the catch 24 (clip 132), preventing the catch 24 from moving to its extended position. The lock plug 18 is held in the actuation position and translated into the lock barrel 12 until the catch 24 abuts the annular rib 50. Then, the lock plug 18 is rotated towards the release position, thereby engaging the catch 24 with one of the shoulders 202. The shoulder 202 forces the catch 24 into the groove 130, thereby allowing the catch 24 and the lock plug 18 to translate past the annular rib 50 into the first position shown in FIG. 1A. While the foregoing is the preferred procedure for translating the catch 24 past the annular rib 50, it will be appreciated by those skilled in the art that it is not the only procedure for assembling the lock plug 18 into the lock barrel 12 or for translating the catch 24 past the annular rib 50.

From the foregoing, it will be appreciated that the combined lock/actuator 10 is capable of actuating the driven member 26 to a desired position when the combined lock/actuator 10 is locked in the actuation position and then maintaining the driven member 26 in the desired position until the combined lock/actuator 10 is unlocked into the release position.

It will also be appreciated that the push button switch lock 30 is capable of activation in an actuation position and incapable of deactivation in the actuation position.

The push button switch lock 30 allows an operator to activate a switch, but prevents the operator from deactivating the switch once it is activated unless the operator is provided with an appropriate key. Such a scenario is presented when it is desired to provide a panic alarm button in environments having a relatively high risk of robbery or hijacking. The push button switch lock 30 allows a person in such an environment to activate a panic alarm whenever threatened by a would-be wrong-doer, but prevents the would-be wrong-doer from deactivating the panic alarm without an appropriate key.

This invention has been described in terms of specific embodiments set forth in detail, but it should be understood that these are by way of illustration only and that the invention is not necessarily limited thereto. Modifications and variations will be apparent from this disclosure and may be resorted to without departing from the spirit of this invention, as those skilled in the art will readily understand. Accordingly, such variations and modifications of the disclosed products are considered to be within the purview and scope of this invention and the following claims.

We claim:

1. A combined lock/actuator for providing linear actuation, said lock/actuator comprising:

a lock barrel having an opening extending along a longitudinal axis;

a lock plug operably mounted directly in said opening, said plug rotatable within said opening over a fixed angular displacement between an actuation position and a released position relative to said barrel while operably mounted in said opening, said plug translatable within said opening over a fixed axial displacement along the longitudinal axis between a first position and a second position relative to said barrel while operably mounted in said opening; and means for preventing rotation of said plug when said plug is in said actuation position and said first position, when said plug is in said actuation position and said second position, and when said plug is in said actuation position and translated between the first and second positions.

2. The combined lock/actuator of claim 1 further comprising means for preventing translation of the plug from the second position when the plug is in said actuation position.

3. The combined lock/actuator of claim 2 wherein said translation preventing means comprises a recess in said barrel and a catch extending from said plug into said recess.

4. A combined lock/actuator for providing linear actuation, said lock/actuator comprising:

a lock barrel having an opening extending along a longitudinal axis;

a lock plug operably mounted in said opening, said plug rotatable within said opening over a fixed angular displacement between an actuation position and a release position while operably mounted in said opening, said plug translatable within said opening over a fixed axial displacement along the longitudinal axis between a first position and a second position while operably mounted in said opening; and means for preventing rotation of said plug when said plug is in said actuation position and said first position, when said plug is in said actuation position and said second position, and when said plug is in said actuation position and translated between the first and second positions, said rotation preventing means including a recessed spline in said opening, said spline having a length at least as great as said fixed axial displacement between the first and second positions; and a tumbler in said plug, said tumbler extended into said spline and translating relative to said spline when said plug is in the actuation position and translated between the first and second positions.

5. A combined lock/actuator for providing linear actuation, said lock/actuator comprising:

a lock barrel having an opening extending along a longitudinal axis;

a stop in said opening of the barrel;

a lock plug mounted in said opening, said plug rotatable within said opening over a fixed angular displacement between an actuation position and a release position, said plug translatable within said opening over a fixed axial displacement along the longitudinal axis between a first position and a second position;

a first axially extending surface on said plug, said first surface having a length at least as great as said fixed axial displacement between said first and second positions, said first surface engaged with said stop when said plug is in both said first position and said actuation position, said first surface engaged with said stop when said plug is in both said second position and said actuation position;

a second axially extending surface on said plug circumferentially spaced from said first axially extending surface, said second surface having a length at least as great as said fixed axial displacement between said first and second positions, said second surface having an angular displacement from said first surface at least as great as said fixed angular displacement between the actuation and release positions, said second surface engaged with said stop when said plug is in said first position and rotated to a stop position, said second surface engaging said stop when said plug is in said second position and rotated to the stop position; and means for preventing rotation of said plug when said plug is in said actuation position and said first position, when said plug is in said actuation position and said second position, and when said plug is in said actuation position and translated between the first and second positions.

6. A combined lock/actuator for actuating a driven member from a primary position to a secondary position when the lock/actuator is locked and then maintaining the driven member in the secondary position until the lock/actuator is unlocked, said lock/actuator comprising:

a lock barrel having a longitudinal axis, an opening extending along the axis, and a recess;

a lock plug operably mounted directly in said opening, said plug rotatable within said opening between an actuation position and a release position and translatable relative to said opening along said axis between a first position where a driven member is in a primary position and a second position where a driven member is in a secondary position while the plug is operably mounted in said opening; and an axial catch mounted on said plug, said catch engaged with said recess when said plug is in both the actuation position and the second position, said catch disengaged from said recess when said plug is in said release position, said catch mounted on said plug for movement between an extended position with said catch engaging said recess and a retracted position with said catch disengaged from said recess.

7. The combined lock/actuator of claim 6 wherein said catch is mounted on said plug for transverse movement between the extended position and the retracted position.

8. The combined lock/actuator of claim 7 further comprising means for disengaging the catch from the recess in response to said plug being rotated from the actuation position to the release position when said plug is in the second position.

9. The combined lock/actuator of claim 8 wherein said disengaging means comprises an edge on said barrel adjacent the recess, said edge engaging said catch and forcing said catch into the retracted position when said plug is rotated from the actuation position to the release position.

10. The combined lock/actuator of claim 7 further comprising means for biasing the catch to the extended position.

11. The combined lock/actuator of claim 7 further comprising a rib fixed to the barrel in said opening, said rib engaged with said catch when said catch is in the retracted position and said plug is in the first position.

12. A combined lock/actuator for actuating a driven member from a primary position to a secondary position when the lock/actuator is locked and then maintaining the driven member in the secondary position until the lock/actuator is unlocked, said lock/actuator comprising:

a lock barrel having a longitudinal axis, an opening extending along the axis, and a recess;

a lock plug rotatable within said opening between an actuation position and a release position and operably translatable within said opening along said axis between a first position where a driven member is in a primary position and a second position where a driven member is in a secondary position, said plug including an arcuate groove; and an axial catch mounted on said plug, said catch engaged with said recess when said plug is in both the actuation position and the second position, said catch disengaged from said recess when said plug is in said release position, said catch being in the form of a generally C-shaped clip that is mounted in said groove.

13. The combined lock/actuator of claim 12 wherein said groove includes two oppositely spaced shoulders and said clip includes two oppositely spaced projections respectively engaged with said shoulders to limit movement of said clip from said groove.

14. The combined lock/actuator of claim 12 further comprising a generally C-shaped leaf spring mounted in said groove between said plug and said clip for biasing said clip to an extended position wherein said catch engages said recess.

15. A push button switch lock capable of activation in a locked, actuation position and incapable of deactivation in the actuation position, said switch lock comprising:

a lock barrel having an opening extending along a longitudinal axis and a recess in said opening;

a lock plug mounted directly in said opening, said plug rotatable within said opening between an actuation position and a release position, said plug translatable within said opening over a fixed axial displacement along the longitudinal axis between a first position and a second position;

an axial catch mounted on said plug and engaged with said recess when said plug is in both the actuation position and the second position, said axial catch disengaged from said recess when said plug is in said release position, said catch mounted on said plug for movement between an extended position with said catch engaging said recess, and a retracted position with said catch disengaged from said recess;

a switch mounted to said barrel, said switch having an activated position and a deactivated position; and means cooperating between the switch and the plug to place the switch in the activated position when the plug is in the second position and in the deactivated position when said plug is in the first position.

16. The switch lock of claim 15 further comprising means for disengaging said catch from said recess when said plug is in both the release position and second position.

17. A pushbutton switch lock capable of activation in a locked, actuation position and incapable of deactivation in the actuation position, said switch lock comprising;

a lock barrel having an opening extending along a longitudinal axis and a recess in said opening, said recess being in the form of a transverse slot in the barrel;

a lock plug rotatable within said opening between an actuation position and a release position, said plug translatable within said opening over a fixed axial displacement along the longitudinal axis between a first position and a second position, said plug including a transverse, arcuate groove;

a C-shaped clip mounted in the groove for transverse movement between an extended position with said clip engaged within said slot, and a retracted position with said clip disengaged from said slot, said clip engaged with said slot when said plug is in both the actuation position and the second position, said clip disengaged from said slot when said plug is in said release position;

a switch mounted to said barrel, said switch having an activated position and a deactivated position; and means cooperating between the switch and the plug to place the switch in the activated position when the plug is in the second position and in a deactivated position when said plug is in the first position.

18. The switch lock of claim 17 further comprising means for disengaging said clip from said slot when said plus is in both the release position and the second position, said disengaging means including a surface on the barrel adjacent the slot, said surface engaged with said clip in the retracted position when the plug is rotated from the actuation position to the release position.

19. The switch lock of claim 17 further comprising a rib fixed to the barrel in said opening, said rib engaged with said clip when said clip is in the retracted position and said plug is in the first position, thereby preventing removal of said plug from said barrel.

20. A pushbutton switch lock capable of activation in a locked, actuation position and incapable of deactivation in the actuation position, said switch lock comprising;

a lock barrel having an opening extending along a longitudinal axis and a recess in said opening;

a lock plug rotatable within said opening between an actuation position and a release position, said plug translatable within said opening over a fixed axial displacement along the longitudinal axis between a first position and a second position;

a recessed spline on the barrel in said opening, said spline having a length at least as great as said fixed axial displacement between the first and second positions;

a tumbler in said plug, said tumbler being extended into said spline when said plug is in the actuation position and translated between the first position and the second position;

an axial catch mounted on said plug and engaged with said recess when said plug is in both the actuation position and the second position, said axial catch is disengaged from said recess when said plug is in said release position;

a switch mounted to said barrel, said switch having an activated position and a deactivated position; and means cooperating between the switch and the plug to place the switch in the activated position when the plug is in the second position and in the deactivated position when said plug is in the first position.

* * * * *